United States Patent [19]

Sweetsir

[11] Patent Number: 4,672,909

[45] Date of Patent: Jun. 16, 1987

[54] RETRACTABLE CLEAT FOR MARINE VESSEL

[76] Inventor: Joel M. Sweetsir, Box 53, Ruby, Ak. 99768

[21] Appl. No.: 817,993

[22] Filed: Jan. 13, 1986

[51] Int. Cl.[4] ..... B63B 21/04

[52] U.S. Cl. ..... 114/218; 410/107

[58] Field of Search ..... 114/218, 236, 199; 24/115 GK, 136 K; 248/499, 500, 503; 410/82, 83, 107, 111

[56] References Cited

U.S. PATENT DOCUMENTS

| | | | |
|---|---|---|---|
| 1,119,252 | 12/1914 | Donnell | 114/218 |
| 3,102,708 | 9/1963 | Crain | 410/107 |
| 4,354,445 | 10/1982 | Kafka et al. | 114/218 |

FOREIGN PATENT DOCUMENTS

| | | | |
|---|---|---|---|
| 1200243 | 7/1970 | United Kingdom | 410/83 |

*Primary Examiner*—Joseph F. Peters, Jr.

*Assistant Examiner*—Edwin L. Swinehart

*Attorney, Agent, or Firm*—St.Onge Steward Johnston & Reens

[57] ABSTRACT

A cleat is described which is adapted to be moved between a stored position substantially flush with the deck of a marine vessel and an operative position projecting above the deck. The cleat is supported on a stem slidably mounted in a cylindrical opening in a housing member. The inner end of the stem is provided with a pin projecting laterally into a groove cut into the wall of the cylindrical opening in the housing. The grooves defines a pathway for the pin to travel of such a configuration that the cleat can be moved from one position to another by partially withdrawing the stem from the housing and rotating it about its longitudinal axis to a predetermined degree in order to assume the second position. The cleat and housing are free of moving parts, are characterized by remarkable ease of operation and can be readily fabricated from corrosion resistant materials.

9 Claims, 6 Drawing Figures

RETRACTABLE CLEAT FOR MARINE VESSEL

BACKGROUND OF THE INVENTION

1. Field of the Invention

This invention relates to marine hardware and is more particularly concerned with an improved cleat which is retractable into a position flush with the marine vessel deck when not use.

2. Description of the Prior Art

A number of cleats have been described previously which, when not in use, are retractable into a position flush with the deck of a marine vessel.

Illustratively, Young U.S. Pat. No. 1,299,529 describes a tubular form of cleat which, in the stored position, is retained in a housing installed in the deck of a vessel. The cleat can be withdrawn a predetermined distance from the housing by releasing a latch on the inner end of the cleat. The latch is actuated by pulling a chain which traverses the hollow interior of the cleat and is attached to a cap which closes the outer end of the cleat. The cleat is prevented from being rotated within the housing by means of a key which seats in a vertical groove in the inner wall of the housing.

Lippincott U.S. Pat. No. 3,093,106 describes a retractable cleat which can be maneuvered from its housing by disengaging a lock plate in the deck plate, and withdrawing the cleat with the aid of guide slots in the housing wall until the feet are aligned with grooves in the deck plate. At this point the cleat is moved horizontally until the lock plate engages the cleat base and retains the cleat in operating position. The series of steps is reversed to retract the cleat into the housing.

Bigelow U.S. Pat. No. 3,126,859 shows a cleat which is retractable against the action of a spring from a stored position to an operating position.

Kafka et al U.S. Pat. No. 4,270,478 describes a cleat mounted on a plate which is adapted to rotate in a housing from a position in which the cleat is above deck in operative position to a position in which the cleat is below deck level and the underside of the mounting plate is flush with the deck.

Kafka et al U.S. Pat. No. 4,354,445 also shows a cleat retractable against the action of a spring and rotatable to a locked position for use. The cleat is returned to a position flush with the deck by reversing the sequence of steps.

I have now found that a retactable cleat can be provided which is free from any springs or moving parts and which is therefore less prone to inactivation due to corrosion and like problems which arise particularly where dissimilar metals are employed in fabrication of the various parts. The cleat of this invention is further characterized by ease of fabrication and ease of operation.

SUMMARY OF THE INVENTION

It is an object of the invention to provide a retractable cleat which is flush with the deck of a marine vessel when not in use but which can be readily and reversibly moved to an operative position when required.

It is a further object of the invention to provide a retractable cleat which does not employ moving parts to actuate or de-actuate the device and which is substantially free from potential corrosion problems.

It is yet another object of the invention to provide a retractable cleat which is of relatively simple but sturdy construction and which can be fabricated throughout from non-corrosive or corrosion resistant materials.

These objects, and other objects which will become apparent from the detailed description which follows, are achieved by the structure of the invention. The latter, in its broadest aspect, comprises a cleat supported on a stem slidably mounted in a cylindrical opening in a housing member. The inner end of the stem is provided with a pin or like means which projects laterally and is received in a groove cut in the side wall of the cylindrical opening in the housing. The groove defines a pathway through which the pin can travel. The pathway is so configured that the cleat with pin attached can be moved from a stored position to an operative position by partially withdrawing the stem from the housing, rotating it about its londitudinal axis to a predetermined degree, and allowing it to move back into the housing to assume the second position. The cleat is prohibited from rotation about its longitudinal axis when in either the stored or operative position by the restraining effect of the pin and groove. The cleat stem can only be rotated after withdrawing the stem partially from the housing until the pin or like means reaches a location in the groove at which rotational movement is possible.

In an optional but preferred feature the stem is also provided with stop means which, when the cleat stem is withdrawn a predetermined distance, engages the underside of a deck plate associated with the housing member and thereby prevents further withdrawal of the stem from the housing.

DETAILED DESCRIPTION OF THE INVENTION

Figure 1:
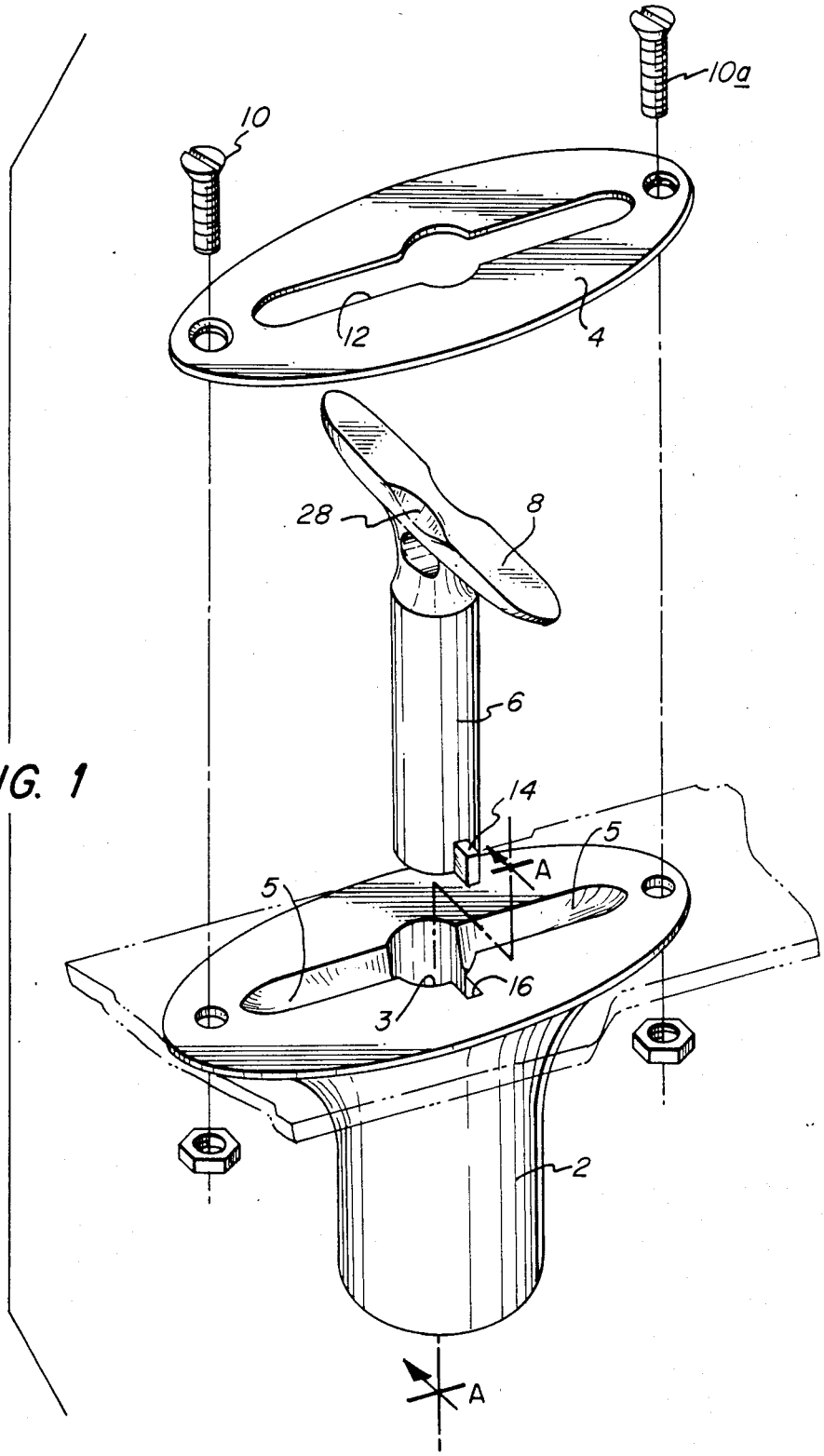
FIG. 1 is an exploded, perspective view of an embodiment of a cleat in accordance with the invention.
Figure 3:
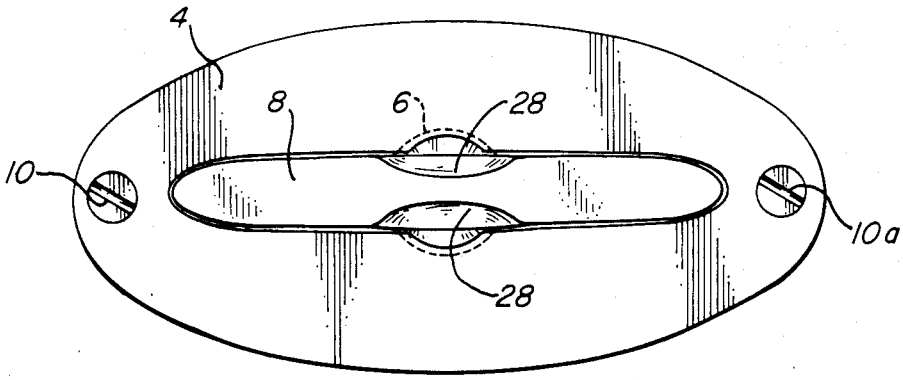
FIG. 3 is a plan view of the top of the embodiment shown in FIG. 1 with the cleat fully retracted into the housing.

Referring to FIG. 1 there is shown, in an exploded perspective view, an embodiment of a retractable cleat in accordance with the invention comprising a housing 2 adapted to be mounted in an appropriate aperture in the deck (not shown) of a marine vessel, a cover plate 4 and a cleat member 8 having a stem 6 adapted to be received in the cylindrical opening 3 in the housing 2. Bolts 10 and 10*a* extend through counter sunk openings in the cover plate 4 and corresponding openings in housing 2 to secure the same to the deck (not shown) of the marine vessel. Alternatively and preferably, the housing 2 is bolted to the deck of the vessel and the cover plate 4 is secured to the housing 2 by means such as screws. The cleat member 8, in the particular embodiment shown, has the elongated, generally ellipsoidal shape characteristic of the majority of cleats. However, it will be appreciated by one skilled in the art that the particular shape of the cleat is not critical and that other shapes, characteristic of cleats commonly employed, can be used without departing from the scope of the invention. In the retracted position of the cleat of the invention the upper surface of the cleat 8 is substantially flush with the upper surface of cover plate 4 as shown in plan view in FIG. 3. The shape of opening 12 in cover plate 4 and of the elongated recess 5 in housing 2 conform to the dimensions of the perimeter and the underside of cleat member 8 in order to permit the cleat 8 to assume the fully retracted position substantially flush with the cover plate 4 and the surrounding deck.

Pin or nub member 14 projects laterally from the perimeter of the lower extremity of stem 6. In order to introduce stem 6 into the opening 3 in housing 2 the pin member 14 is brought into registry with opening 16 in the perimeter of opening 3 as shown in FIG. 1, and the stem 6 is then partially inserted into opening 3 until the pin member 14 is received in the horizontal section 22 of a continuous groove cut into the interior wall of opening 3 as shown in dotted line configuration in the cross-sectional view shown in FIG. 2A and further illustrated in FIG. 2B which is a cross-sectional view taken along the line B—B in FIG. 2A.

Figure 2A:
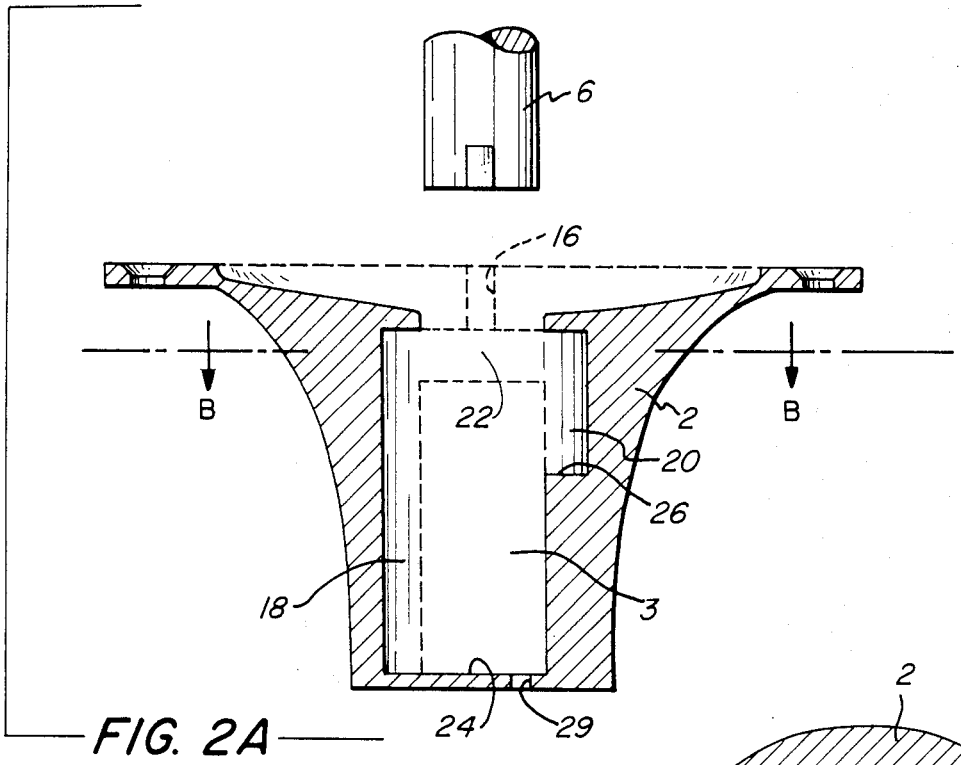
FIG. 2A is a partial cross-sectional view taken along the line A—A of the embodiment shown in FIG. 1.
Figure 2B:
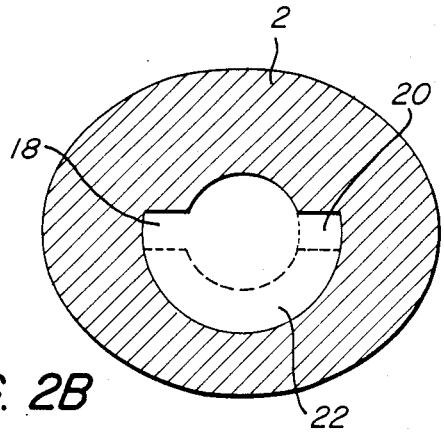
FIG. 2B is a partial cross-sectional plan view taken along the line B—B in FIG. 2A.

The horizontal section 22 of said groove, in the particular embodiment shown in FIG. 2A, traverses a semicircular path in the sidewall of opening 3 and serves to bridge two sections 18 and 20 of the groove which sections are of unequal length and are both aligned substantially parallel to the longitudinal axis of cylindrical opening 3. Groove section 18 is the longer of the two. It is of a length and cross-sectional dimension such that, when the stem 6, after being inserted through opening 23 so that pin member 14 is received in groove section 22, is rotated about its longitudinal axis to bring pin member 14 to the upper end of the groove section 18, said pin member 14 can pass downwardly in said section 18 a sufficient distance to permit the stem 6 and attached cleat 8 to be fully retracted into the housing 2 and cover plate 4.

Groove section 20 is shorter than section 18 and is of a length and cross-sectional dimension such that, when stem 6 is rotated in the above manner but in the opposite direction in order to bring pin member 14 into registry with said section 20, the pin member 14 can only pass downwardly a limited distance until it makes contact with, and is restrained by, the lower end 26 of said groove section. In this position the cleat member 18 projects above the deck level a sufficient distance to be in the operative position. It will be readily apparent to one skilled in the art that the cleat 8 and attached stem 6 can be moved from the retracted to the operative position or vice versa by withdrawing the stem 6 a sufficient distance so that pin member 14 reaches the top of whichever of groove sections 20 and 18 it is located and is then caused to traverse groove section 22 by appropriate rotation of stem 6 until it is located at the head of the other of vertical groove sections 20 and 18. The stem then retracts into the opening 3 as the pin member 14 descends into the vertical groove section in question.

If, during the traversal of horizontal groove section 22, the pin member 14 should be withdrawn accidentally through entry groove 16, the complete withdrawal of the stem 6 and attached cleat 8 from housing 3 is prevented by contact between pin member 14 and the underside of cover plate 4.

In a modification of the embodiment shown in FIG. 1 the opening 12 in the deck plate can be modified in size so that the stem 6 is of too large a cross-sectional dimension to pass through said opening while the cleat 8 can still pass therethrough. In such a modification the longitudinal movement of the stem is restricted, i.e. the stem can only be withdrawn to the point at which the top of the stem encounters the underside of the deck plate, but this limited travel of the stem still permits the pin member 14 to come into register with the groove section 22.

In the embodiment shown in FIG. 1 the pin or nub member 14 is illustrated as having a substantially square cross-section and the various groove sections 16, 18, 20 and 22 having similar cross-sections permitting the pin member 14 to be received in, and to traverse, these sections. It will be recogized by one skilled in the art that the pin member 14 can assume other shapes such as cylindrical, elliposidal and the like without departing from the scope of the present invention. Similarly, the cross-section of the groove sections can be modified to accommodate any particular shape of pin member.

In an optional embodiment of the invention the cleat 8 is provided with curved indentations 28 which provide means for the operator of the cleat to grasp the same when the cleat is in the retracted position.

In another optional embodiment the housing 2 is provided with drain hole 29 which serves to allow any water entering the opening 3 to be drained therefrom and also serves to facilitate insertion of stem 6 into opening 3 by allowing air to be displaced as the stem 6 is lowered into the opening. The drain hole 29 can be provided with valve means or removable plug, if desired, in order to prevent or minimize the passage of water into the below deck area.

Figure 4:
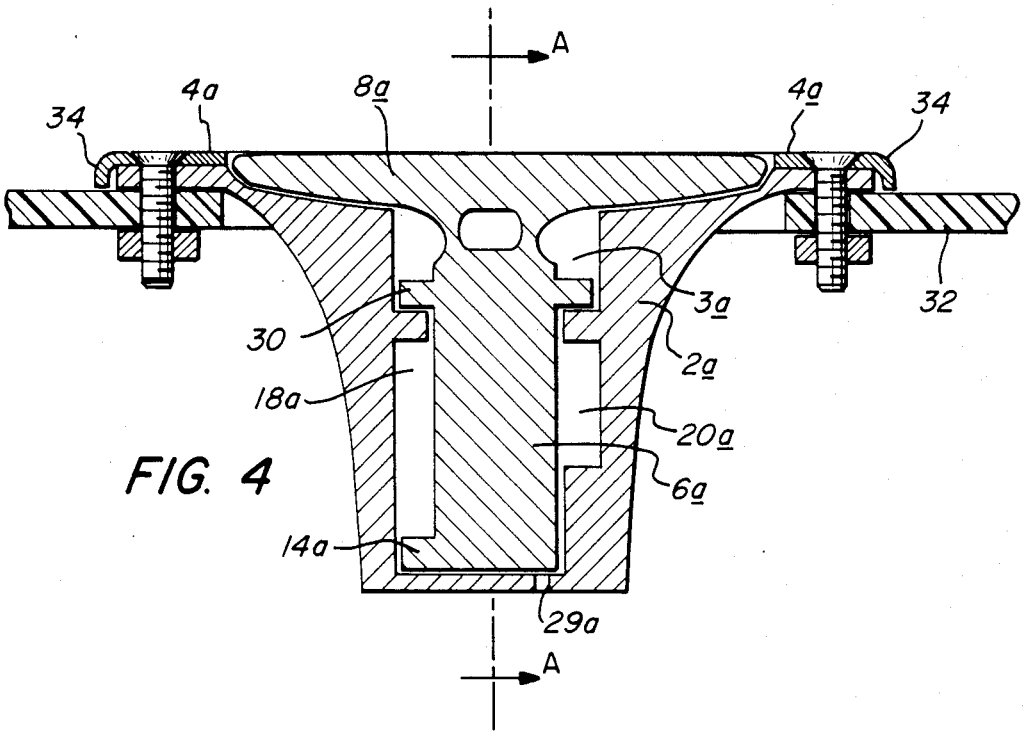
FIG. 4 is a cross-sectional view of an alternative embodiment of a cleat in accordance with the invention.
Figure 4A:
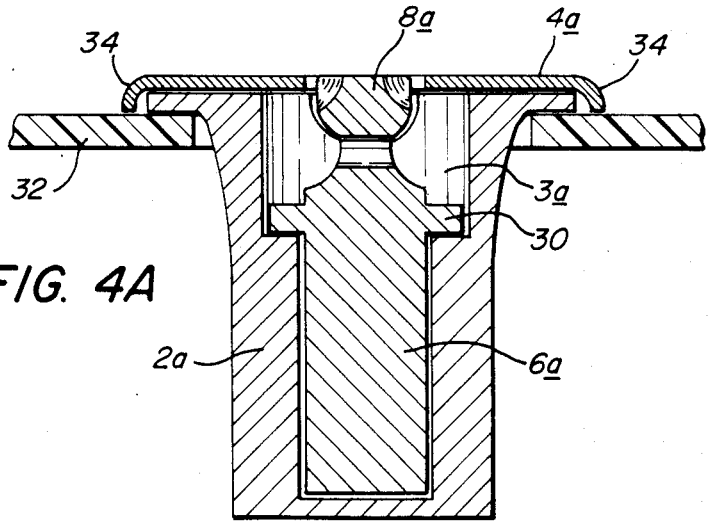
FIG. 4A is a cross-sectional view taken along the line A—A in the view shown in FIG. 4.

An alternative embodiment of a cleat of the invention is shown in cross-section in FIGS. 4 and 4A in the retracted position and installed in the deck 32 of a marine vessel. In this embodiment the various features common to this embodiment and the previous embodiment are shown by the same numerals to which the letter "a" has been added. The novel feature of the alternative embodiment comprises the addition of annular ring 30 which projects from the upper end of stem **6*a* and the widening of the upper end of opening 3*a* in order to permit limited longitudinal movement of said stem in said opening. The cleat 8*a* is moved from the retracted position, substantially flush with cover plate 4*a* as shown in FIGS. 4 and 4A to the operative position using the procedure described above for the previous embodiment. However, in the case of this alternative embodiment the presence of the annular rim 30 serves to eliminate the possibility that the pin member 14*a* may be accidentally withdrawn through entry groove 16 (not shown in the embodment of FIGS. 4 and 4A) while being caused to traverse the horizontal groove section 22 (also not shown in the said FIGURES). Thus the annular rim 30 is located on stem 6*a* then, when the latter is withdrawn to the position in which pin member 14 is located in horizontal groove section 22, the upper edge of rim 30 is abutting the underside of cover plate 4*a*. The rim 30 therefore acts as a stop means which limits the extent to which stem 6*a* can be withdrawn from the opening 3*a* and effectively prevents accidental withdrawal of the stem at the point at which pin member 14*a*** is in registry with the entry groove during rotation of the stem in passing from the retracted to the operative position or vice versa.

An additional advantage which is manifested by the embodiment of FIGS. 4 and 4A is that, as the stem **6*a* is withdrawn, the annular rim 30 serves to clean out any debris and/or water trapped in the upper portion of opening 3*a*. Further by providing washers or like sealing means on the lower side of annular rim 30 it is possible to prevent, or minimize, the passage of water into the interior of opening 3***a* when the cleat is in the stored position.

In the embodiment shown in FIGS. 4 and 4A the cover plate 4*a* is shown with rounded edges 34 which overlap the peripheral edges of housing 2*a*. This is a preferred feature of the invention which serves to eliminate any sharp edges and thus avoids a potential source of abrasion for lines which may be secured to the cleat.

All three components of the cleat in accordance with the invention, namely, the cleat with attached stem, the housing and the cover plate are fabricated from metal such as brass, stainless steel, corrosion-resistant alloys and the like. Preferably the same material is used to fabricate all three parts.

While the invention has been described by reference to certain specific embodiments thereof it is to be understood that these were offered merely as illustrations and the invention is not limited to these particular embodiments. Various modifications will be apparent to one skilled in the art which could be made in these specific embodiments without departing from the scope of the invention. Illustratively, while the embodiments illustrated above permit the stem 6 or 6*a* to be rotated through substantially 180°, i.e. the groove section 22 describes a semi-circle, it is to be understood that this is not critical to operation of the device and that any shorter or longer path can be employed to permit a rotation which is preferably at least 45° but not as high as 360°. The housing member can be fabricated as a single component with the grooves cut in the sidewall of the cylindrical opening by appropriate machining. Alternatively the cylindrical opening can be provided with an appropriate liner provided with the necessary grooves and fabricated from the same material as the housing and securely affixed therein by appropriate means such as screws.

What is claimed is:

1. A cleat adapted to be moved between a stored position substantially flush with the deck of a marine vessel and an operative position projecting above the deck, said cleat comprising in combination:

a housing having a substantially cylindrical shape with a substantially circular opening therein;

a detachable cover plate for said housing adapted to be mounted substantially flush with the deck of said vessel and provided with an opening registering with that in said housing;

a cleat member comprising a cleat supported by a stem mounted slidably in said housing;

pin means affixed to and projecting laterally from a lower end of said stem;

a continuous groove in the wall of said cylindrical opening in said housing and adapated to receive said pin means;

said groove defining a pathway travelled by said pin means to allow said cleat member to be moved reversibly between said stored position and said operative position.

2. A cleat according to claim 1 wherein said groove defines a pathway so configured that said cleat member can be partially withdrawn from said housing and rotated less than 360° about its longitudinal axis.

3. A cleat according to claim 1 wherein the path defined by said groove comprises a bridge section which lies in a plane substantially perpendicular to the longitudinal axis of the cylindrical housing and which connects two groove sections of unequal length disposed substantially parallel to the said longitudinal axis and projecting downwardly in the wall of said opening away from the entrance thereto.

4. A cleat according to claim 3 wherein the longer of the two unequal groove sections has a length such as to accommodate said pin means when the cleat and stem are fully retracted into the housing.

5. A cleat according to claim 3 wherein the shorter of the two unequal groove sections has a length such as to maintain the cleat in the operative position when the pin means has fully traversed the lenght of said groove.

6. A cleat according to claim 3 wherein the said bridge section of said groove extends approximately 180° around the inner perimeter of the cylindrical housing in the plane in which said bridge section is disposed.

7. A cleat according to claim 1 wherein said stem is provided with stop means adapted to engage the underside of said cover plate when said cleat is withdrawn a predetermined distance from said cylindrical opening.

8. A cleat according to claim 7 wherein said stop means comprises an annular ring projecting from said stem.

9. A cleat according to claim 8 wherein said said annular ring is positioned on said stem at a location such that said ring is in abutting relationship with the underside of said cover plate when said stem is withdrawn from said housing to the position at which said pin means registers with the bridge section of said groove.

* * * * *